US007952303B2

(12) United States Patent
Xiong et al.

(10) Patent No.: US 7,952,303 B2
(45) Date of Patent: May 31, 2011

(54) ELECTRONIC BALLAST FOR A GAS DISCHARGE LAMP WITH CONTROLLED FILAMENT HEATING DURING DIMMING

(75) Inventors: Wei Xiong, Madison, AL (US); Christopher Radzinski, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 464 days.

(21) Appl. No.: 12/193,521

(22) Filed: Aug. 18, 2008

(65) Prior Publication Data

US 2009/0230887 A1 Sep. 17, 2009

Related U.S. Application Data

(60) Provisional application No. 61/036,277, filed on Mar. 13, 2008.

(51) Int. Cl.
*H05B 37/02* (2006.01)

(52) U.S. Cl. ..... 315/307; 315/DIG. 4; 315/94; 315/209 R

(58) Field of Classification Search ..... 315/209 R, 315/210, 219, 220, 221, 224, 225, 226, 291, 315/299, 307, 308, 312, 313, DIG. 4, 94, 315/95, 97, 98, 105
See application file for complete search history.

(56) References Cited

U.S. PATENT DOCUMENTS 4,686,427 A 8/1987 Burke
4,931,701 A * 6/1990 Carl ..... 315/240
5,451,843 A * 9/1995 Kahn et al. ..... 315/186
5,841,239 A 11/1998 Sullivan
6,031,340 A * 2/2000 Brosius ..... 315/227 R
6,043,611 A 3/2000 Gradzki
6,603,274 B2 8/2003 Ribarich
6,686,705 B2 2/2004 Nerone
6,873,121 B1 3/2005 Stevens
7,154,229 B2 12/2006 Alexandrov
7,187,132 B2 * 3/2007 Bakre ..... 315/94
7,247,991 B2 7/2007 Chen
7,564,192 B2 * 7/2009 Collins et al. ..... 315/247
2007/0138967 A1 6/2007 Chen et al.
2008/0054825 A1 3/2008 Gulsen et al.

* cited by examiner

*Primary Examiner* — T C Patel
*Assistant Examiner* — Amy Yang
(74) *Attorney, Agent, or Firm* — Waddey & Patterson; Mark J. Patterson

(57) ABSTRACT

An electronic ballast has control circuitry to operate a gas discharge lamp in both full and dimmed illumination modes. The electronic ballast also includes a full power circuit having a power control coupled to the dimming controller output to receive the dimming controller signal, a filament heating circuit having a heating input coupled to a reduced power circuit to receive a reduced power signal and a heating output that can couple to the filaments of one or more lamps. When the full power circuit receives the dimming controller signal, via the power control, and the dimming controller signal is not in the dimming request range (i.e. the full illumination mode has been selected), the full power circuit generates a full power signal capable of driving/operating the lamp(s) in the full illumination mode. When the reduced power signal is present, the filament heating circuit generates and provides a filament heating signal to the filaments, via the heating output.

20 Claims, 3 Drawing Sheets

ELECTRONIC BALLAST FOR A GAS DISCHARGE LAMP WITH CONTROLLED FILAMENT HEATING DURING DIMMING

CROSS-REFERENCE TO RELATED APPLICATIONS

This application is a non-provisional application which claims benefit of U.S. Patent Application Ser. No. 61/036,277 filed Mar. 13, 2008, entitled "Novel Program Start Dimming Ballast for Independent Parallel Lamp Operation" which is hereby incorporated by reference.

BACKGROUND OF THE INVENTION

The present invention relates generally to electronic ballasts for gas discharge lamps. More particularly, the present invention pertains to electronic ballasts capable of operating one or more lamps in both a full illumination (brightness) mode and a dimmed illumination mode—an illumination level less than the full illumination mode. Even more particularly, the present invention relates to electronic ballasts that can operate the lamps in a dimmed illumination mode and provide appropriate lamp filament heating to ensure stable and reliable operation of the lamp in the dimmed mode.

A crucial aspect of operating a gas discharge lamp, whether in a full illumination or dimmed illumination mode, concerns proper heating of the lamp's filaments. Without proper filament heating, the performance and reliability of the lamp(s) will degrade. Specifically, without proper heating, the filaments will not be able to thermionically emit electrons in sufficient quantities to maintain an arc (required for proper lamp operation). Further, attempts to operate the lamp while the filaments are not in the desired temperature range will result in damage to the filaments and/or the thermionically emissive material coating the filaments and lead to premature lamp failure.

The luminosity or brightness of the lamp and the level of filament heating are controlled, in large part, by the current passing through the filaments. For example, when the lamps are operated in a full illumination mode, the current passing through the filaments is at or near the lamp's maximum operational limits (to generate a light output adequate for the full illumination mode) and is typically sufficient to heat the filaments without additional assistance.

Conversely, when the lamp(s) are operated in a dimmed illumination mode, the current passing through the filaments is reduced. Although the reduced current presented to the filaments permits dimmed mode illumination, the reduced current will often not be adequate to reliably operate the lamp-depending on the extent of dimming. As such, supplemental heating must be supplied to the filaments to avoid the above-mentioned complications associated with deficient filament heating.

What is needed, then, is an electronic ballast that can operate a lamp in both full and dimmed illumination modes and provide supplemental heating to the filaments when the lamp is operated in the dimmed illumination mode in a reliable, cost-effective manner.

BRIEF SUMMARY OF THE INVENTION

The present invention relates generally to an electronic ballast having control circuitry to operate a gas discharge lamp in both full and dimmed illumination modes. Further, the present invention supplies supplemental filament heating when the lamp is operated in the dimmed illumination mode.

It is often desirable to adjust the illumination intensity (brightness) of a lamp. To this end the present invention includes a dimming controller having a dimming controller output. The dimming controller serves as the mechanism to permit a selection between full and dimmed illumination modes. The full illumination mode describes the maximum light output of the lamp(s) or the maximum allowable output (which may be lower than the maximum light output for, example, reliability concerns). The dimmed illumination mode describes a light output less than that of the full illumination mode.

The selection of either the full or dimmed illumination mode causes the dimming controller to produce a dimming controller signal at the dimming controller output. The dimming controller signal has a dimming request range which describes the range of dimming controller signal magnitudes (or other defining signal characteristics such as frequency or phase) that correlate to the selection of the dimmed illumination mode.

The electronic ballast also includes a full power circuit having a power control coupled to the dimming controller output to receive the dimming controller signal. The full power circuit also has a full power output that can couple to the lamp. When the full power circuit receives the dimming controller signal, via the power control, and the dimming controller signal is not in the dimming request range (i.e. the full illumination mode has been selected), the full power circuit generates a full power signal capable of driving/operating the lamp(s) in the full illumination mode. Further, the full power circuit delivers the full power signal to the lamp(s) via the full power output.

To drive/operate the lamp(s) in the dimmed illumination mode, the present invention includes a reduced power circuit. The reduced power circuit provides a reduced power signal when the full power signal is not supplied to the lamp(s). Alternatively described, the reduced power circuit generates a reduced power signal when the dimming controller signal is in the dimming request range. The magnitude of the reduced power signal is less than the full power signal to cause the lamp(s) to operate with a light output less than that of the full illumination mode—the dimmed illumination mode.

As discussed above, when lamps are operated in a dimmed illumination mode, supplemental filament heating should be supplied to forestall premature lamp failure or poor lamp performance. The filament heating circuit serves this role in the present invention.

The filament heating circuit has a heating input coupled to the reduced power circuit, to receive the reduced power signal, and a heating output that can couple to the filaments of one or more lamps. When the reduced power signal is present, the filament heating circuit generates and provides a filament heating signal to the filaments, via the heating output. The filament heating signal maintains the temperature of the filaments when the lamp(s) are operated in the dimmed illumination mode. Further, the filament heating signal is responsive to the reduced power signal. In one embodiment, the filament heating signal is a derivation of the reduced power signal; i.e. the filament heating signal is based on the reduced power signal.

DETAILED DESCRIPTION OF THE INVENTION

The present invention relates generally to an electronic ballast having full and dim illumination control circuitry. More specifically, the present invention relates to an electronic ballast capable of operating a lamp in both a full or maximum illumination mode and a dimmed illumination mode. Moreover, the present invention also provides supplemental heating to the filaments of the lamp(s) when the lamp(s) are operated in the dimmed illumination mode.

Figure 1:
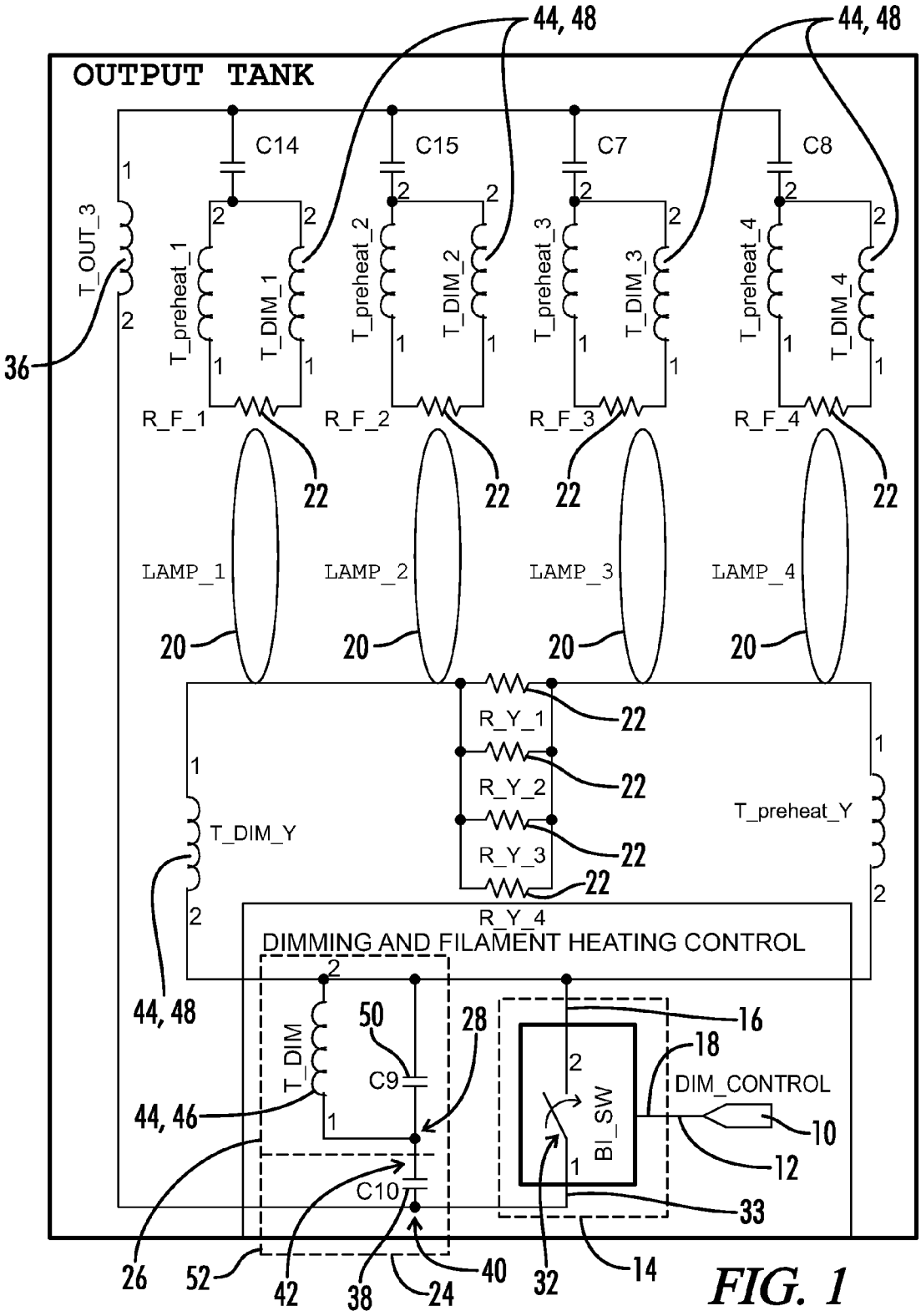
FIG. 1 is a schematic of one embodiment of the present invention.
Figure 3:
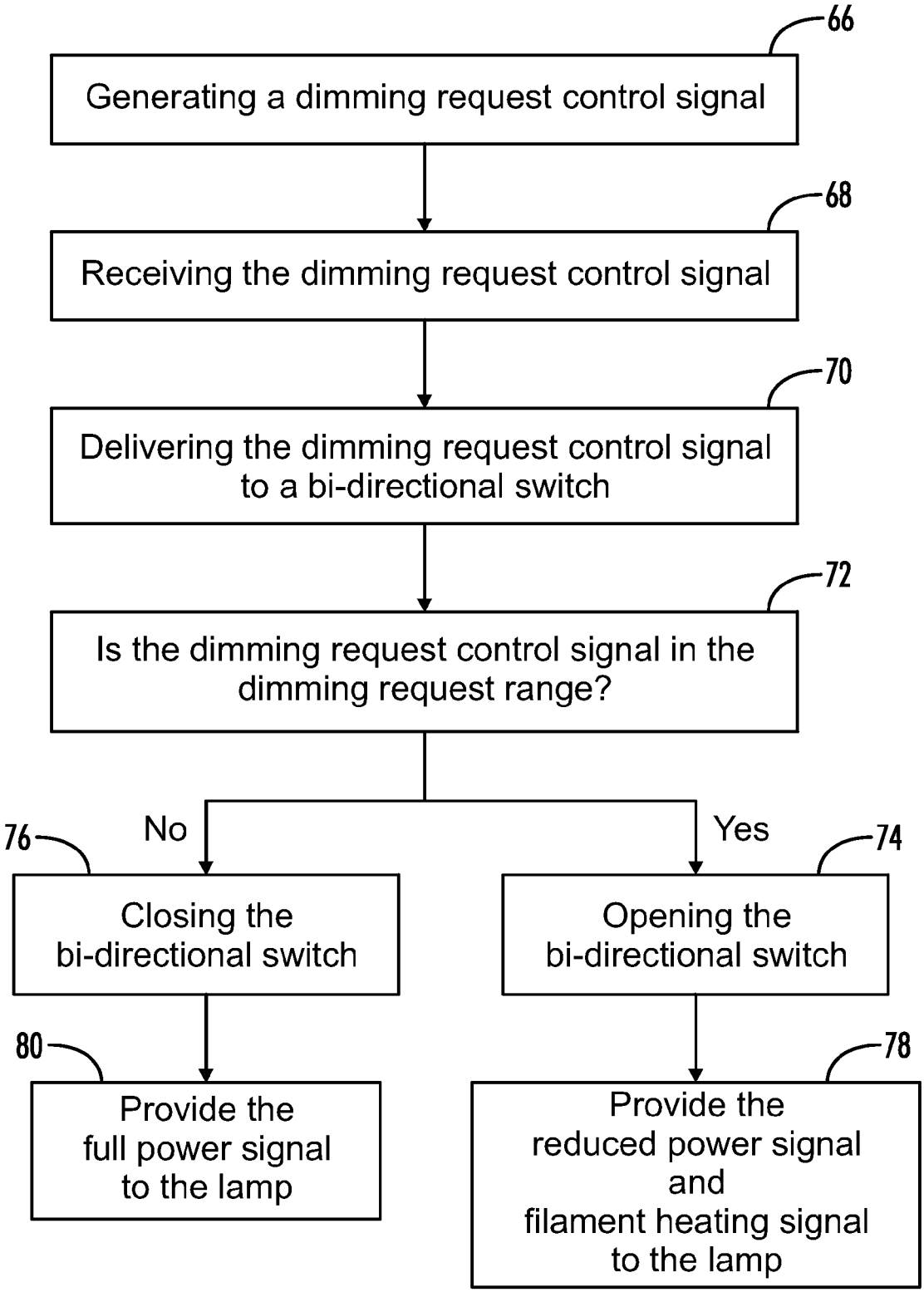
FIG. 3 is a flow diagram of the operation of one embodiment of the present invention.

FIG. 1 illustrates one embodiment of the present invention having a dimming controller 10 with a dimming controller output 12. The dimming controller 10 permits selection between at least two different illumination levels or modes (preferably full illumination and dimmed illumination). For example, the dimming controller 10 may be one or a combination of an integrated circuit, a user selectable switch, a rheostat, or the like. Depending on the desired illumination level/mode, the dimming controller 10 will generate a dimming controller signal or a dimming controller output signal, at the dimming controller output 12, having a magnitude (and/or phase and/or frequency) corresponding to the desired illumination mode, as shown in step 66 of FIG. 3. The dimming controller signal may also describe, or include, the absence of any signal from the dimming controller 10, as the absence of a signal also provides information.

The dimming controller signal has a dimming request range. The dimming request range encompasses the characteristics (e.g. magnitude, phase and/or frequency) of the dimming controller signal that indicate that a dimmed illumination mode is desired. For example, the dimming request range may span dimming controller signal magnitudes between zero and three volts. Thus, if the dimming controller signal has a magnitude of two volts then the dimmed illumination level/mode has been selected.

Figure 2:
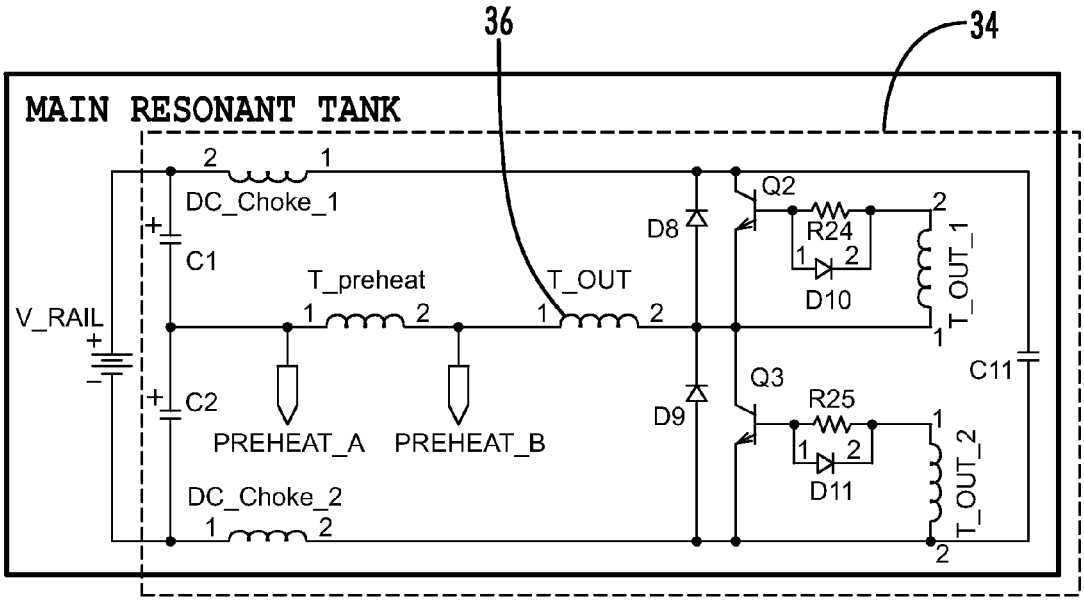
FIG. 2 is a schematic of one embodiment of a power converter circuit of an electronic ballast.

The electronic ballast of the present invention also includes a power converter circuit 34 (FIG. 2). The power converter circuit 34 accepts a DC signal and converts the DC signal into AC signals that are provided to drive the lamp(s). The power converter circuit 34 includes, typically, two or four switching transistors (four transistors corresponding to a full bridge circuit) that facilitate the conversion of the DC signals into AC signals suitable to drive the lamp(s) 20, via the filaments 22. More particularly, the power converter circuit 34 may include a resonant output transformer 36 used to provide a transformer output signal to drive, at least in part, the lamp(s).

The present invention also has a full power circuit 14 with a full power output 16 that can couple to the lamp (after the lamp has been connected to the ballast). In one preferred embodiment, the full power output 16 may be a connector 16 that engages the filaments of the lamp(s). However, the full power output 16 may also describe any output port that is capable of delivering an electrical signal directly to the lamp or indirectly to the lamp through a separate coupling mechanism. The full power circuit 14 also has a power control 18 coupled to the dimming controller output 12 to receive the dimming controller signal, as shown in FIG. 1 and step 68 of FIG. 3.

When the dimming controller signal is not in the dimming request range, the full power circuit 14 generates a full power signal (or a full power output signal) at the full power output 16, which can then be supplied to the filaments of the lamp(s). The full power signal has a magnitude (or signal level/strength) that functions to operate the lamp(s) in the full illumination mode.

In one preferred embodiment, the full power circuit 14 may be coupled to the resonant output transformer 36 to receive the transformer output signal, by which the full power output signal may be modulated. Specifically, the full power circuit 14 may employ a bi-directional switch 32 having an input 33 coupled to the resonant output transformer 36, an output 16 (or lamp connector 16) adapted to couple to the lamps (or the filaments of the lamp(s)), and be responsive to the dimming controller signal—step 70 of FIG. 3. Thus, in one embodiment, when the dimming controller signal is not in the dimming request range, the bi-directional switch 32 communicates the transformer output signal to the lamp(s)—the changes to the transformer output signal as a result of the communication process through the bi-directional switch 32 or more generally the full power circuit 14 result in the full power signal.

In effect, when the dimming controller signal is not in the dimming request range, the bi-directional switch 32 is closed or in a closed state, creating a low electrical impedance path or a virtual short circuit between the resonant output transformer 36 and the filament of the lamp, thereby allowing the transformer output signal (referred to as the full power signal after entering the full power circuit 14) to be supplied to the lamp. Conversely, when the dimming controller signal is in the dimming request range, the bi-directional switch 32 is open or in an open state, creating a high electrical impedance path or an open circuit, thereby preventing the transformer output signal (or the full power signal) from being supplied to the lamp(s).

The present invention uses a reduced power circuit 24 to operate the lamp(s) in the dimmed illumination mode. Functionally, the reduced power circuit 24 provides a reduced power signal to the lamp(s) when the full power signal is not present, or equivalently, when the dimming controller signal is in the dimming request range. Thus, the reduced power circuit 24 may be coupled to either the full power circuit 14 or the dimming controller 10 to determine when the dimmed illumination mode has been selected. As the dimmed illumination mode mandates that the illumination intensity ("brightness") of the lamp(s) be less than that of the full illumination mode, the magnitude of the reduced power signal is less than the magnitude of the full power signal. In one embodiment, the reduced power circuit 24 may comprise a power reduction capacitor 38 with a first connector 40 coupled to the resonant output transformer 36 to receive the transformer output signal, the basis for the reduced power signal. The power reduction capacitor 38 serves as a current limiter to ensure that the reduced power circuit 24 drives the lamp(s) at a brightness level less than that caused by the full power circuit 14, as the full power circuit 14 has no such current limiting device. The extent of dimming (i.e. current limiting) can be adjusted by varying the capacitance/impedance of the power reduction capacitor 38.

However, as mentioned above, when the reduced power signal is employed to drive the lamp(s), supplemental heating must be provided to the filaments to ensure reliable lamp operation. To accomplish this task, a filament heating circuit 26 is used. The filament heating circuit 26 has a heating input 28 coupled to the reduced power circuit 24 and a heating output (not shown) that can couple to the filaments. Accordingly, when the dimming controller signal is in the dimming request range or the reduced power signal present, the filament heating circuit 26 generates a filament heating signal at the heating output (not shown) so that the filament heating signal can be delivered to the filaments. Because the filament heating signal is only generated when the reduced power signal is present, the filament heating signal can be described as being responsive to the reduced power signal. Moreover, in some embodiments the filament heating signal is a derivation of the reduced power signal, i.e. the filament heating signal is based on the reduced power signal.

The filament heating circuit 26 may comprise a heating transformer 44 with a primary winding 46 and a secondary winding 48 (or multiple secondary windings 48) for coupling to the filament (or filaments). The primary winding 46 has an input coupled to the reduced power circuit 24 or, more specifically in a preferred embodiment, to the second connector of the power reduction capacitor 42, as shown in FIG. 1. Consequently, when the reduced power circuit 24 produces the reduced power signal, some or all of the reduced power signal is received by the primary winding 46. This causes a corresponding current in the secondary winding 48 which heats the filaments. This supplemental heating allows the lamp(s) to operate efficiently and reliably when in the dimmed illumination mode. The filament heating circuit 26 may also have a heating capacitor 50 in parallel electrical connection with the primary winding 46.

In the preferred embodiment, the filament heating circuit 26 and the reduced power circuit 24 are in electrical series connection and define a dimming mode circuit 52 which is in parallel electrical connection with the full power circuit 14. Even more particularly, the power reduction capacitor 38 is in electrical series connection with the combination of the primary winding 46 and the heating capacitor 50 (which are in parallel electrical connection); this arrangement of the power reduction capacitor 38, the primary winding 46, and the heating capacitor 50 may also define the dimming mode circuit 52. Further, this embodiment of the dimming mode circuit 52 is in parallel electrical connection with the bi-directional switch 32, as shown in FIG. 1.

With the described embodiment in mind, the operation of the present invention will be further detailed. First, consider that the full illumination mode has been selected—resulting in the dimming controller signal (or dimming request control signal) being out of the dimming request range. This causes the bi-directional switch 32 to close, i.e. provide a low impedance path from the resonant output transformer 36 to the lamp(s) or the filaments of the lamp(s), as shown in steps 72 and 76 of FIG. 3.

Because the now closed bi-directional switch 32 (or full power circuit 14 more generally) is in parallel electrical connection with the dimming mode circuit 52; which is comprised of the power reduction capacitor 38, the primary winding 46, and the heating capacitor 50 (or equivalently, the reduced power circuit 24 and the filament heating circuit 26), the transformer output signal will select the path presented by the bi-directional switch 32 instead of the dimming mode circuit 52, as the switch 32 presents a lower impedance path. Thus, the full power signal is provided to the lamp(s), as shown in step 80 of FIG. 3. Note that the full power signal results from the transformer output signal's interaction with the bi-directional switch 32.

Conversely, when the dimmed illumination mode is selected, the dimming controller signal is in the dimming request range. This causes the bi-directional switch 32 to open, i.e. presenting a high impedance to the transformer output signal, as shown in steps 72 and 74 of FIG. 3. Because the bi-directional switch 32 is now open, the transformer output signal will select the path presented by the dimming mode circuit 52 as it has an impedance lower than the opened switch 32. Accordingly, the reduced power signal and the filament heating signal will be provided to the lamp(s), as shown in step 78 of FIG. 3. The reduced power signal has a magnitude less than the full power signal, when generated, because of the current limiting effect of power reduction capacitor 38.

As the reduced power circuit 24 and the filament heating circuit 26 are in electrical series connection, when the transformer output signal is provided to the reduced power circuit 24 (thereby creating the reduced power signal), the transformer output signal/reduced power signal also cause the filament heating signal to be generated. Again, note that the reduced power and filament heating signals result from the transformer output signal's interaction with the dimming mode circuit 52 or alternatively worded, are modulated by the transformer output signal. In this way the present invention operates to provide both full and dimmed illumination modes and supplemental filament heating when the lamp is operated in the dimmed illumination mode.

Thus, although there have been described particular embodiments of the present invention of a new and useful ELECTRONIC BALLAST FOR A GAS DISCHARGE LAMP WITH CONTROLLED FILAMENT HEATING DURING DIMMING, it is not intended that such references be construed as limitations upon the scope of this invention except as set forth in the following claims.

What is claimed is:

1. An electronic ballast for a gas discharge lamp having a filament, comprising:

a dimming controller having a dimming controller output and operable to generate a dimming controller signal at the dimming controller output, wherein the dimming controller signal has a dimming request range;

a full power circuit having a full power output for coupling to the lamp, a power control coupled to the dimming controller output to receive the dimming controller signal, wherein the full power circuit is operable to generate a full power signal at the full power output when the dimming controller signal is not in the dimming request range, and further wherein the full power signal has a magnitude;

a reduced power circuit operable to provide a reduced power signal to the lamp when the full power signal is not present, and wherein the reduced power signal has a magnitude less than the magnitude of the full power signal; and a filament heating circuit having a heating input coupled to the reduced power circuit and a heating output for coupling to the filament, wherein the filament heating circuit is operable to generate a filament heating signal, responsive to the reduced power signal, at the heating output when the reduced power signal is present.

2. The ballast of claim 1 wherein the full power circuit includes a bi-directional switch.

3. The ballast of claim 2, further comprising:

a resonant output transformer; and wherein the bi-directional switch has an input coupled to the resonant output transformer and an output for coupling to the lamp.

4. The ballast of claim 3 wherein the reduced power circuit comprises a power reduction capacitor with a first connector coupled to the resonant output transformer and a second connector coupled to the filament heating circuit.

5. The ballast of claim 4 wherein the filament heating circuit comprises a heating transformer with a primary winding, coupled to the second connector of the power reduction capacitor, and a secondary winding for coupling to the filament.

6. The ballast of claim 5 wherein the filament heating circuit further comprises a heating capacitor in parallel electrical connection with the primary winding of the heating transformer.

7. The ballast of claim 4 wherein the filament heating circuit and the reduced power circuit define a dimming mode circuit in parallel electrical connection with the full power circuit.

8. A method of using an electronic ballast to dim a gas discharge lamp having a filament, comprising:

(a) generating a dimming control request signal, wherein the dimming control request signal has a dimming request range;

(b) receiving the dimming control request signal in the electronic ballast;

(c) if the dimming control request signal is in the dimming request range, providing to the lamp both a reduced power signal to dim the illumination of the lamp and a filament heating signal to heat the filament during dimming, wherein the reduced power signal has a magnitude and the filament heating signal is responsive to the reduced power signal; and (d) if the dimming control request signal is out of the dimming request range, providing to the lamp a full power signal, wherein the full power signal has a magnitude greater than the reduced power signal.

9. The method of claim 8 wherein step (b) further comprises:

delivering the dimming control request signal to a bi-directional switch coupled between a power converter circuit and a lamp connector for coupling to the lamp.

10. The method of claim 9 wherein step (d) further comprises:

closing the bi-directional switch to provide the full power signal to the lamp, via the lamp connector.

11. The method of claim 9 wherein step (c) further comprises:

opening the bi-directional switch.

12. An electronic ballast for a gas discharge lamp having a filament, comprising:

a power converter circuit having a resonant output transformer operable to generate a transformer output signal;

a dimming controller operable to generate a dimming controller output signal, wherein the dimming controller output signal has an dimming request range range;

a full power circuit coupled to the resonant output transformer to receive the transformer output signal, wherein the full power circuit is operable to receive the dimming controller output signal and to provide a full power output signal to the filament when the dimming controller output signal is not in the dimming request range, and further wherein the full power output signal is modulated by the transformer output signal and has a magnitude; and a dimming mode circuit coupled to the resonant output transformer to receive the transformer output signal, wherein the dimming mode circuit is operable to receive the dimming controller output signal and to provide both a filament heating signal and a reduced power signal to the filament when the full power output signal is not present, wherein the reduced power signal is modulated by the transformer output signal and has a magnitude less than the full power output signal and the filament heating signal is modulated by the reduced power signal.

13. The ballast of claim 12 wherein the full power circuit comprises a bi-directional switch.

14. The ballast of claim 13 wherein the bi-directional switch has an open state and a closed state and when the dimming controller output signal is not in the dimming request range, the bi-directional switch is in the closed state.

15. The ballast of claim 14 wherein when the dimming controller output signal is in the dimming request range, the bi-directional switch is in the open state.

16. The ballast of claim 12 wherein the dimming mode circuit comprises a power reduction capacitor having a first connector, coupled to the resonant output transformer to receive the transformer output signal, and a second connector.

17. The ballast of claim 16 wherein the dimming mode circuit comprises a heating transformer having a primary winding coupled to the second connector of the power reduction capacitor.

18. The ballast of claim 17 wherein the dimming mode circuit further comprises a heating capacitor in parallel electrical connection with the primary winding of the heating transformer.

19. The ballast of claim 12 wherein the dimming mode circuit has an impedance and when the dimming controller output signal is not in the dimming request range, the full power circuit has an impedance less than the impedance of the dimming mode circuit.

20. The ballast of claim 12 wherein the full power circuit and the dimming mode circuit are in parallel electrical connection.

* * * * *